US007373989B2

(12) United States Patent
Setterberg, Jr.

(10) Patent No.: US 7,373,989 B2
(45) Date of Patent: May 20, 2008

(54) FLOW NOZZLE ASSEMBLY

(75) Inventor: John R. Setterberg, Jr., Huntsville, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 234 days.

(21) Appl. No.: 11/148,405

(22) Filed: Jun. 8, 2005

(65) Prior Publication Data

US 2005/0284643 A1 Dec. 29, 2005

Related U.S. Application Data

(63) Continuation-in-part of application No. 10/876,249, filed on Jun. 23, 2004, now abandoned.

(51) Int. Cl.
*E21B 43/08* (2006.01)

(52) U.S. Cl. ..... 166/378; 166/227; 166/222

(58) Field of Classification Search ..... 166/378, 166/227, 222, 311; 138/140, 148
See application file for complete search history.

(56) References Cited

U.S. PATENT DOCUMENTS

| | | | | |
|---|---|---|---|---|
| 2,800,912 | A * | 7/1957 | McCamish et al. | 137/68.23 |
| 3,145,776 | A * | 8/1964 | Pittman | 166/55 |
| 3,198,256 | A * | 8/1965 | Kirby, II | 166/99 |
| 3,823,789 | A * | 7/1974 | Garner | 175/340 |
| 4,037,661 | A * | 7/1977 | Ford | 166/311 |
| 4,126,193 | A * | 11/1978 | Brown et al. | 175/171 |
| 4,189,243 | A * | 2/1980 | Black | 366/336 |
| 4,498,543 | A | 2/1985 | Pye et al. | |
| 4,826,217 | A * | 5/1989 | Guerrero | 285/141.1 |
| 5,661,767 | A * | 8/1997 | Roux | 376/260 |
| 5,823,273 | A * | 10/1998 | Ravi et al. | 175/72 |
| 5,842,516 | A | 12/1998 | Jones | |
| 5,918,911 | A * | 7/1999 | Sims | 285/13 |
| 6,138,777 | A * | 10/2000 | Fraim et al. | 175/92 |
| 6,227,303 | B1 | 5/2001 | Jones | |
| 6,491,097 | B1 | 12/2002 | Oneal et al. | |
| 2002/0125006 | A1 | 9/2002 | Hailey, Jr. et al. | |

FOREIGN PATENT DOCUMENTS

| | | |
|---|---|---|
| GB | 640310 | 7/1950 |
| GB | 2178342 | 2/1987 |
| WO | WO 2004/018837 | 3/2004 |

OTHER PUBLICATIONS

GB Search Report, Application No. 0611228.8, dated Sep. 29, 2006.
EP Search Report, Application No. 05012494.0-2315, dated Jan. 16, 2006.

* cited by examiner

*Primary Examiner*—Kenneth Thompson
(74) *Attorney, Agent, or Firm*—Patterson & Sheridan, LLP

(57) ABSTRACT

The present invention generally provides apparatuses and methods for an improved shunt nozzle which is part of an alternative pathway for a slurry to by-pass an obstruction such as a sand bridge during gravel packing. In one embodiment, the nozzle has a hardened insert that lines a surface of a hole in the shunt and seats on a surface of a wall proximate the hole, thereby restraining movement of the insert relative to the shunt for welding an outer jacket to the shunt.

34 Claims, 5 Drawing Sheets

FLOW NOZZLE ASSEMBLY

CROSS-REFERENCE TO RELATED APPLICATIONS

This application is a continuation-in-part of U.S. patent application Ser. No. 10/876,249, filed Jun. 23, 2004, now abandoned which is herein incorporated by reference.

BACKGROUND OF THE INVENTION

1. Field of the Invention

Embodiments of the present invention generally relate to methods and apparatuses for providing a more uniform gravel pack in a wellbore. More particularly, the invention relates to methods and apparatuses for providing an improved nozzle for a shunt tube.

2. Description of the Related Art

Hydrocarbon wells, especially those having horizontal wellbores, typically have sections of wellscreen comprising a perforated inner tube surrounded by a screen portion. The purpose of the screen is to block the flow of unwanted materials into the wellbore. Despite the wellscreen, some contaminants and other unwanted materials like sand, still enter the production tubing. The contaminants occur naturally and are also formed as part of the drilling process. As production fluids are recovered, the contaminants are also pumped out of the wellbore and retrieved at the surface of the well. By controlling and reducing the amount of contaminants that are pumped up to the surface, the production costs and valuable time associated with operating a hydrocarbon well will likewise be reduced.

One method of reducing the inflow of unwanted contaminants is through gravel packing. Normally, gravel packing involves the placement of gravel in an annular area formed between the screen portion of the wellscreen and the wellbore. In a gravel packing operation, a slurry of liquid, sand and gravel ("slurry") is pumped down the wellbore where it is redirected into the annular area with a cross-over tool. As the gravel fills the annulus, it becomes tightly packed and acts as an additional filtering layer along with the wellscreen to prevent collapse of the wellbore and to prevent the contaminants from entering the stream of production fluids pumped to the surface. Ideally, the gravel will be uniformly packed around the entire length of the wellscreen, completely filling the annulus. However, during gravel packing, the slurry may become less viscous due to loss of fluid into the surrounding formations or into the wellscreen. The loss of fluid causes sand bridges to form. Sand bridges are a wall bridging the annulus and interrupting the flow of the slurry, thereby preventing the annulus from completely filling with gravel.

The problem of sand bridges is illustrated in FIG. 1, which is a side view, partially in section of a horizontal wellbore with a wellscreen therein. The wellscreen 30 is positioned in the wellbore 14 adjacent a hydrocarbon bearing formation therearound. An annulus 16 is formed between the wellscreen 30 and the wellbore 14. The Figure illustrates the path of gravel 13 as it is pumped down the production tubing 11 in a slurry and into the annulus 16 through a crossover tool 33.

Also illustrated in FIG. 1 is a formation including an area of highly permeable material 15. The highly permeable area 15 can draw liquid from the slurry, thereby dehydrating the slurry. As the slurry dehydrates in the permeable area 15 of the formation, the remaining solid particles form a sand bridge 20 and prevent further filling of the annulus 16 with gravel. As a result of the sand bridge, particles entering the wellbore from the formation are more likely to enter the production string and travel to the surface of the well. The particles may also travel at a high velocity, and therefore more likely to damage and abrade the wellscreen components.

In response to the sand-bridging problem, shunt tubes have been developed creating an alternative path for gravel around a sand bridge. According to this conventional solution, when a slurry of sand encounters a sand bridge, the slurry enters an apparatus and travels in a tube, thereby bypassing the sand bridge to reenter the annulus downstream.

FIG. 2 is a sectional view of a prior art nozzle assembly 50 disposed on a shunt tube 55. The construction for an exit point from the shunt tube 55 involves drilling a hole 80 in the side of the tube, typically with an angled aspect, in approximate alignment with the slurry flow path 75, to facilitate streamlined flow. The nozzle assembly 50, having a tubular outer jacket 65, and a tubular carbide insert 60, is held in alignment with the drilled hole 80, and the outer jacket is attached to the tube with a weld 70, trapping the carbide insert 60 against the tube 55, in alignment with the drilled hole 80. The nozzle assembly 50 also has an angled aspect, pointing downward and outward, away from the tube 55. Sand slurry exiting the tube 55 through the nozzle 50 is routed through the carbide insert 60, which is resistant to damage from the highly abrasive slurry.

Both the method of constructing the nozzle 50 and the nozzle itself suffer from significant drawbacks. Holding the nozzle assembly 50 in correct alignment while welding is cumbersome. A piece of rod (not shown) must be inserted through the nozzle assembly 50, into the drilled hole 80, to maintain alignment. This requires time, and a certain level of skill and experience. During welding, the nozzle assembly 50 can shift out of exact alignment with the drilled hole in the tube due to either translational or rotational motion. After welding, exact alignment between the nozzle 50 and the drilled hole 80 is not assured. Because the carbide insert 60 actually sits on the surface of the tube 55, the hole 80 in the tube wall is part of the exit flow path 75. Abrasive slurry, passing through the hole, may cut through the relatively soft tube 55 material, and bypass the carbide insert 60 entirely, causing tube failure.

Therefore, there exists a need for an improved nozzle assembly for a shunt tube and a method for attaching the nozzle to the shunt tube.

SUMMARY OF THE INVENTION

The present invention generally provides apparatuses and methods for an improved shunt nozzle which is part of an alternative pathway for a slurry to by-pass an obstruction such as a sand bridge during gravel packing.

In one aspect of the invention, a nozzle assembly is provided for use in a tool having a hole through a wall of the tool, comprising: an insert configured to at least partially line the hole and seat on a surface of the wall proximate the hole, thereby restraining movement of the insert relative to the tool.

Preferably, the insert comprises a first portion; and a shoulder portion between the first portion and a lip portion, wherein the shoulder portion is configured to seat on the surface of the wall proximate the hole. Further, the lip portion may be configured to at least partially line the hole and comprise a tapered portion that is configured to form an interference fit with a surface of the wall defining the hole.

The nozzle assembly may further comprise a jacket having a bore therethrough and a recessed portion for receiving the first portion of the insert. The nozzle may be constructed from a relatively hard material, such as a carbide material. The insert may have a bore therethrough and may be configured so that a center of the bore will be substantially aligned with a center of the hole when the insert is seated on the wall of the tool.

In another aspect, a nozzle assembly is provided for use in a tool having a hole through the wall of the tool, comprising: an insert having a bore therethrough, wherein the insert is configured to mate with the tool so that a center of the bore is held in substantial alignment with a center of the hole.

In another aspect, a method is provided for attaching a nozzle assembly to a tool, comprising: inserting an insert into a hole in a wall of the tool until the insert seats on a surface of the wall proximate the hole, thereby lining at least a portion of the hole with the insert and restraining movement of the insert relative to the tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted; however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
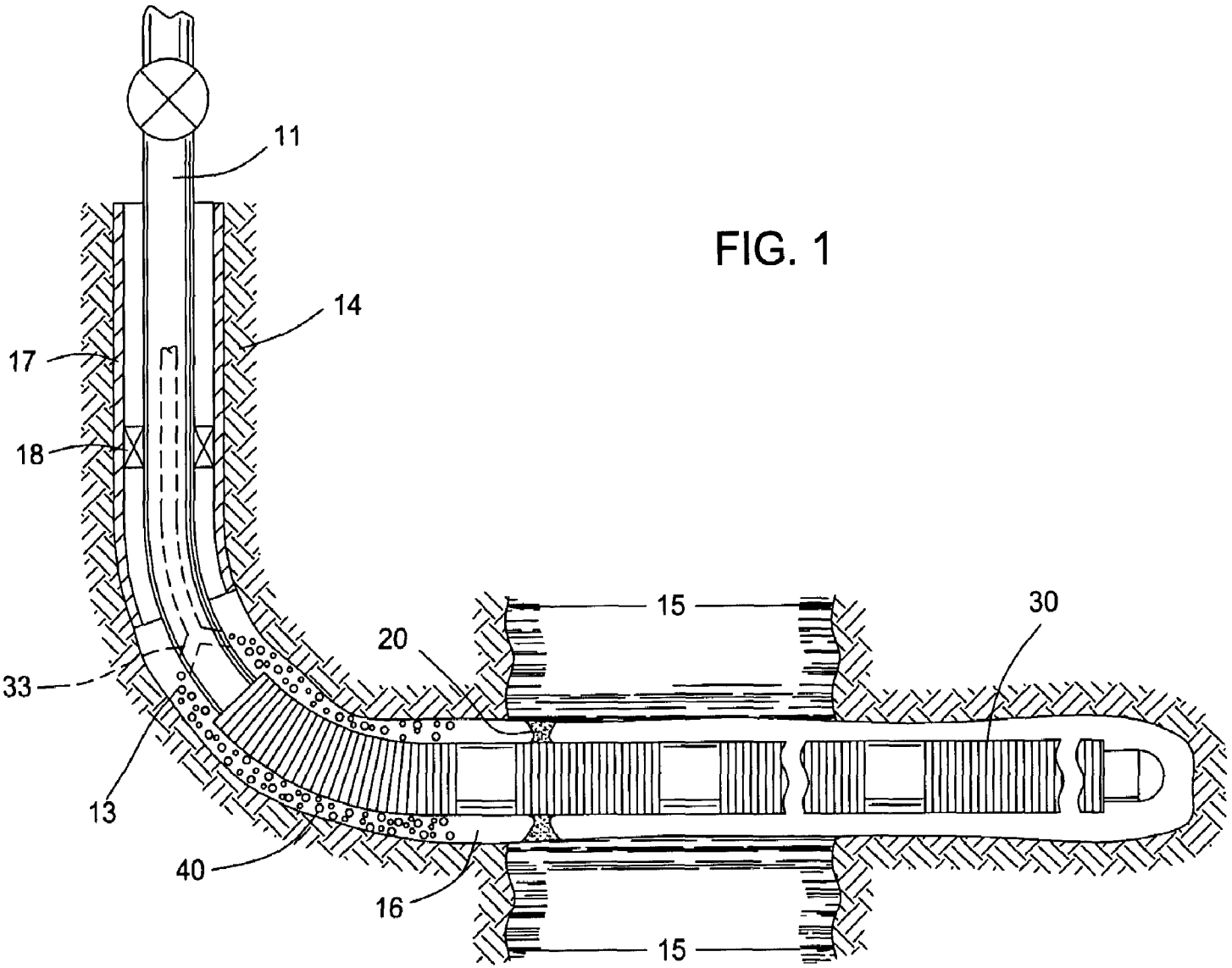
FIG. 1 is a side view, partially in section of a horizontal wellbore with a wellscreen therein.
Figure 2:
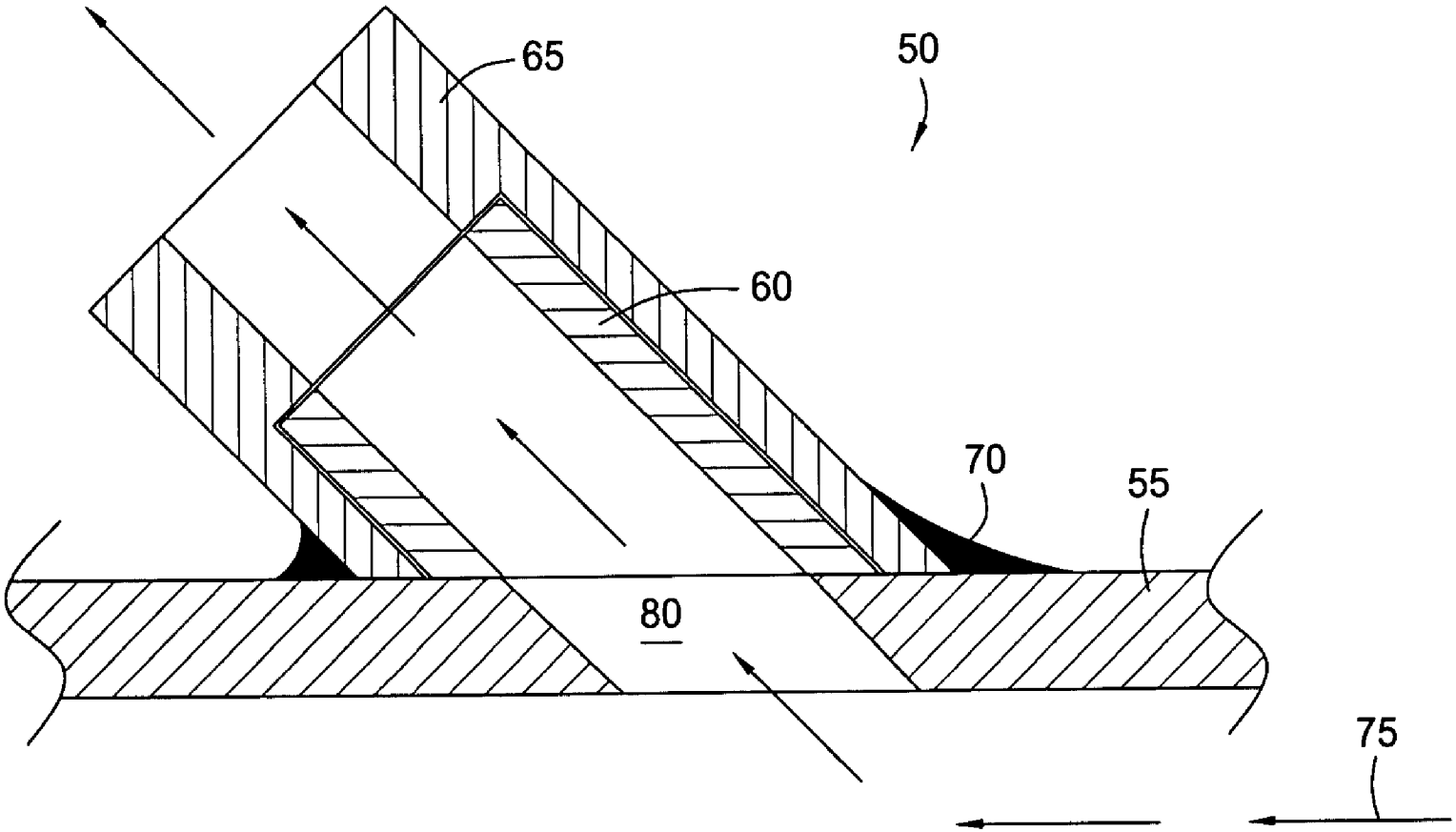
FIG. 2 (PRIOR ART)
FIG. 2 is a sectional view of a prior art flow nozzle configuration.
Figure 3A:
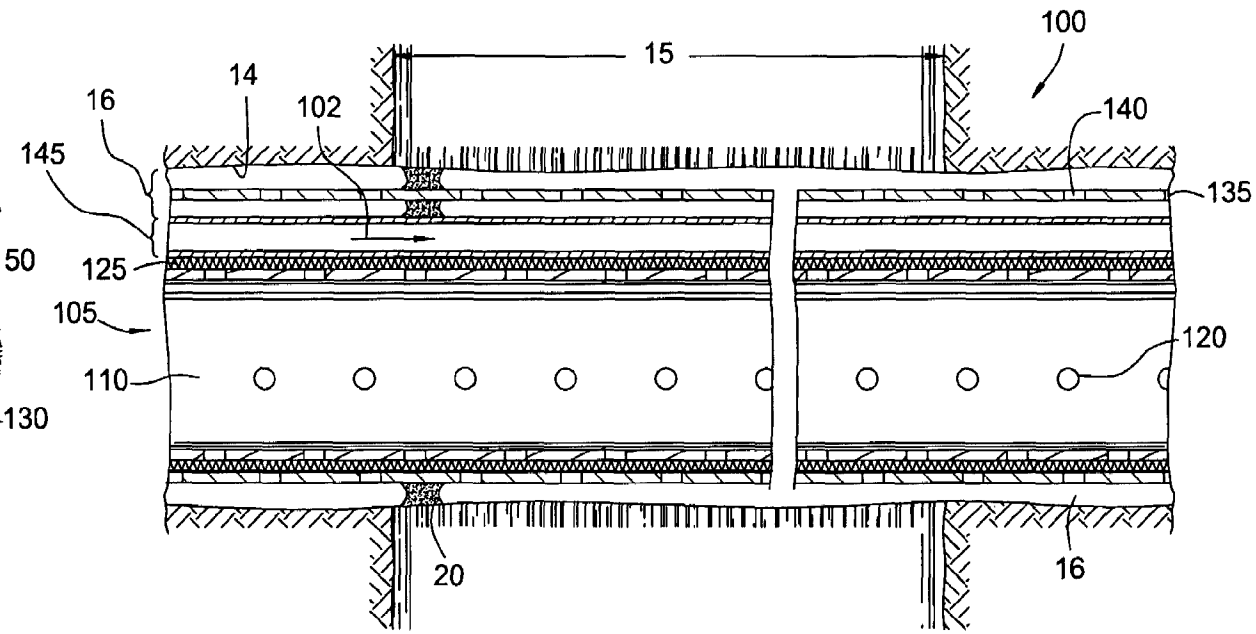
FIG. 3A is a sectional view, taken along line 3A-3A of FIG. 3, of the gravel pack apparatus positioned within wellbore adjacent a highly permeable area of a formation.
Figure 3B:
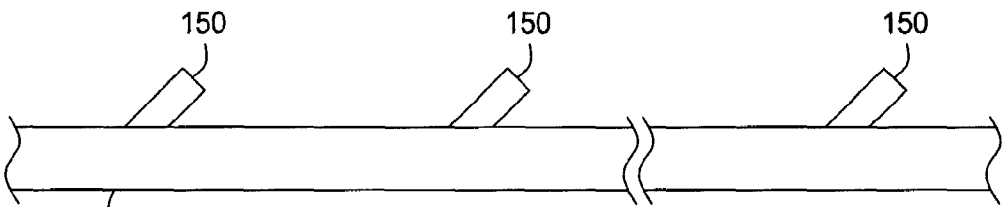
FIG. 3B is a schematic of one of the shunts showing the placement of nozzles along the shunt.
Figure 3:
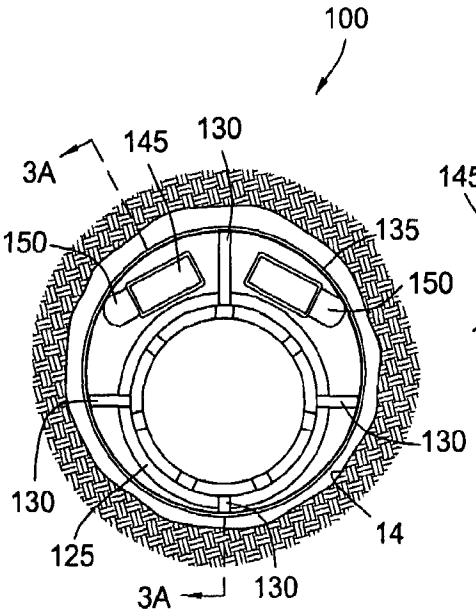
FIG. 3 is a top end view of a gravel pack apparatus, according to one embodiment of the present invention, positioned within a wellbore.

FIG. 3 is a top end view of a gravel pack apparatus 100, according to one embodiment of the present invention, positioned within wellbore 14. FIG. 3A is a sectional view, taken along line 3A-3A of FIG. 3, of the gravel pack apparatus 100 positioned within wellbore 14 adjacent the highly permeable area 15 of a formation. Although apparatus 100 is shown in a horizontal wellbore, it can be utilized in any wellbore. Apparatus 100 may have a "cross-over" sub 33 (see FIG. 1) connected to its upper end which, in turn, is suspended from the surface on a tubing or work string (not shown). Apparatus 100 can be of one continuous length or it may consist of sections (e.g. 20 foot sections) connected together by subs or blanks (not shown). Preferably, all components of the apparatus 100 are constructed from a low carbon or a chrome steel unless otherwise specified; however, the material choice is not essential to the invention.

Apparatus 100 includes a wellscreen assembly 105. As shown, wellscreen assembly 105 comprises a base pipe 110 having perforations 120 through a wall thereof. Wound around an outer side of the base pipe 110 is a wire wrap 125 configured to permit the flow of fluids therethrough while blocking the flow of particulates. Alternatively, wellscreen assembly 105 may be any structure commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof).

Also disposed on the outside of the base pipe 110 are two shunts 145. The number and configuration of shunts 145 is not essential to the invention. The shunts 145 may be secured to the base pipe 110 by rings (not shown). At an upper end (not shown) of the apparatus 100, each shunt 145 is open to the annulus. Each one of the shunts 145 is rectangular with a flow bore therethrough; however, the shape of the shunts is not essential to the invention. Disposed on a sidewall of each shunt is a nozzle 150.

FIG. 3B is a schematic of one of the shunts 145 showing the placement of nozzles 150 along the shunt 145. As shown, a plurality of nozzles 150 are disposed axially along each shunt 145. Each nozzle 150 provides slurry fluid communication between one of the shunts 145 and an annulus 16 between the wellscreen 105 and the wellbore 14. As shown, the nozzles 150 are oriented to face an end of the wellbore 14 distal from the surface (not shown) to facilitate streamlined flow of the slurry 13 therethrough.

Disposed on the outside of the base pipe 110 are a plurality of centralizers 130 that can be longitudinally separated from a length of the base pipe 110 that has the perforations 120 and the wire wrap 125. Additionally, a tubular shroud 135 having perforations 140 through the wall thereof can protect shunts 145 and wellscreen 105 from damage during insertion of the apparatus 100 into the wellbore. The perforations 140 are configured to allow the flow of slurry 13 therethrough.

In operation, apparatus 100 is lowered into wellbore 14 on a workstring and is positioned adjacent a formation. A packer 18 (see FIG. 1) is set as will be understood by those skilled in the art. Gravel slurry 13 is then pumped down the workstring and out the outlet ports in cross-over sub 33 to fill the annulus 16 between the wellscreen 105 and the wellbore 14. Since the shunts 145 are open at their upper ends, the slurry 13 will flow into both the shunts and the annulus 16. As the slurry 13 loses liquid to the high permeability portion 15 of the formation, the gravel carried by the slurry 13 is deposited and collects in the annulus 16 to form the gravel pack. If the liquid is lost to a permeable stratum 15 in the formation before the annulus 16 is filled, the sand bridge 20 is likely to form which will block flow through the annulus 16 and prevent further filling below the bridge. If this occurs, the gravel slurry will continue flowing through the shunts 145, bypassing the sand bridge 20, and exiting the various nozzles 150 to finish filling annulus 16. The flow of slurry 13 through one of the shunts 145 is represented by arrow 102.

Figure 4:
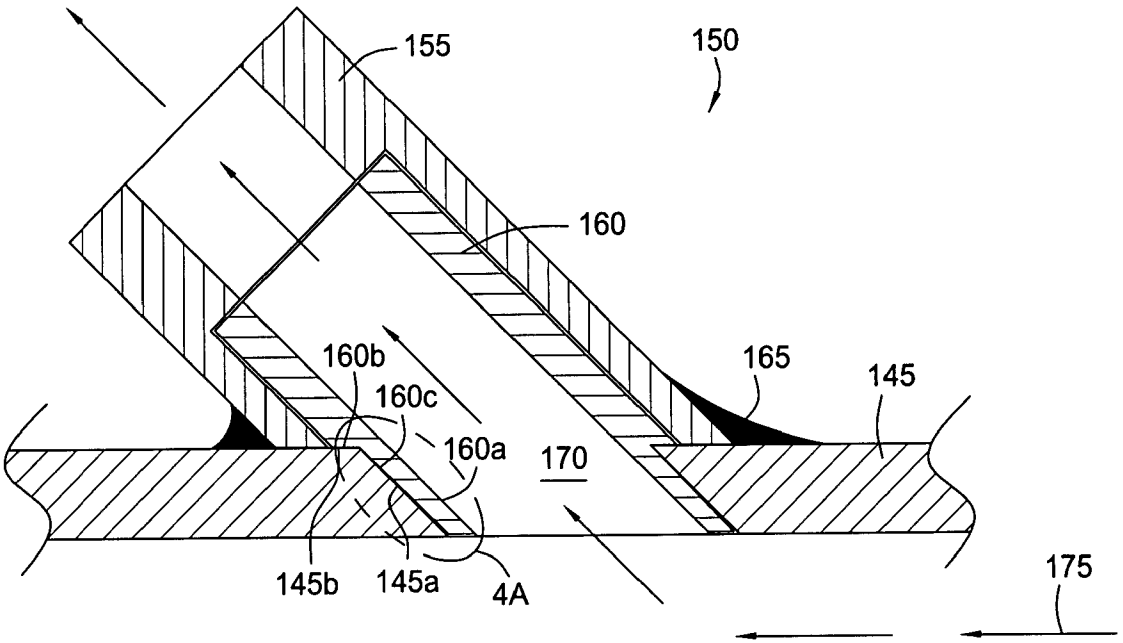
FIG. 4 is a sectional view of a nozzle assembly, according to one embodiment of the present invention, disposed on one of the shunts.
Figure 4A:
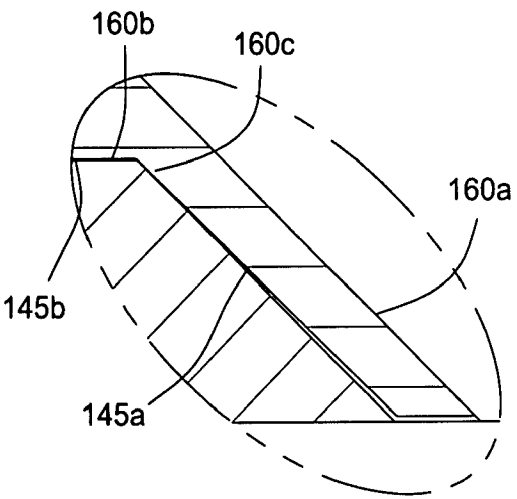
FIG. 4A is an enlargement of a portion of FIG. 4 indicated by the dotted oval labeled 4A.

FIG. 4 is a sectional view of a nozzle assembly 150, according to one embodiment of the present invention, disposed on one of the shunts 145. FIG. 4A is an enlargement of a portion of FIG. 4 indicated by the dotted oval labeled 4A. The nozzle assembly 150 comprises an insert 160 with a flow bore therethrough, that features a lip 160*a* that extends into a drilled hole 170 in a wall of the shunt 145, thereby lining a surface 145*a* of the shunt wall that defines the hole 170. Preferably, the insert is made from a hard material, e.g., carbide, relative to the material of the shunt 145. As shown, the length of the lip 160*a* is substantially the same as the wall thickness of the shunt 145. However, the lip 160*a* may be substantially longer or shorter than the wall thickness of the shunt 145. Preferably, the lip 160*a* features a slight taper on an outer surface 160*c* for seating on the surface 145*a* of the shunt wall, thereby providing a slight interference fit; however, the taper is not essential to the invention. The insert 160 also features a shoulder 160*b* which seats with a surface 145*b* of the shunt wall proximate the hole 170, thereby providing a rigid stop limiting the depth to which lip 160*a* can penetrate the shunt 145. An outer jacket 155 having a flow bore therethrough and a recess configured to receive a portion of the insert 160 may then be easily slipped on and secured to the shunt 145 with a weld 165. Preferably, the outer jacket 155 and insert 160 are tubular members; however, their shape is not essential to the invention. Preferably, the hole 170 is not perpendicular to the surface 145*b* of the shunt proximate the hole; however, the hole may be perpendicular to the surface of the shunt proximate the hole.

Assembly of the nozzle assembly 150 is as follows. The insert 160 is inserted into the hole 170 until the taper of the outer surface 160*c* of the hard insert 160 is press fit with the shunt surface 145*a* defining the hole 170 and the shoulder 160*b* is seated on the shunt surface 145*b* proximate the hole 170, so that the lip 160*a* lines the surface 145*a* and the insert 160 is secured to the shunt 145. In other words, the smallest end of the taper is inserted into the hole 170 first, and the tapered surface of the insert 160 self-centers until it becomes snugly seated against the side of the hole 170 at the surface 145*a*. This contact occurs in the approximate area of surface 160*c* on the carbide insert. The outer jacket 155 can be disposed over an outer surface of the insert 160 and securely welded with minimal handling. Assembly time is greatly reduced, as is the required skill level of the assembler. Once seated, the nozzle assembly 150 is restrained from translating or rotating relative to the shunt 145. Alignment of the insert bore and the jacket bore with the drilled hole 170 in the shunt 145 is assured. Sand slurry 13 exiting the tube, represented by arrows 175, passes through the lip 160*a* of the hard insert, not the surface 145*a* of the hole 170. The possibility of flow cutting the surface 145*a* of the hole 170 is greatly diminished.

Figure 5:
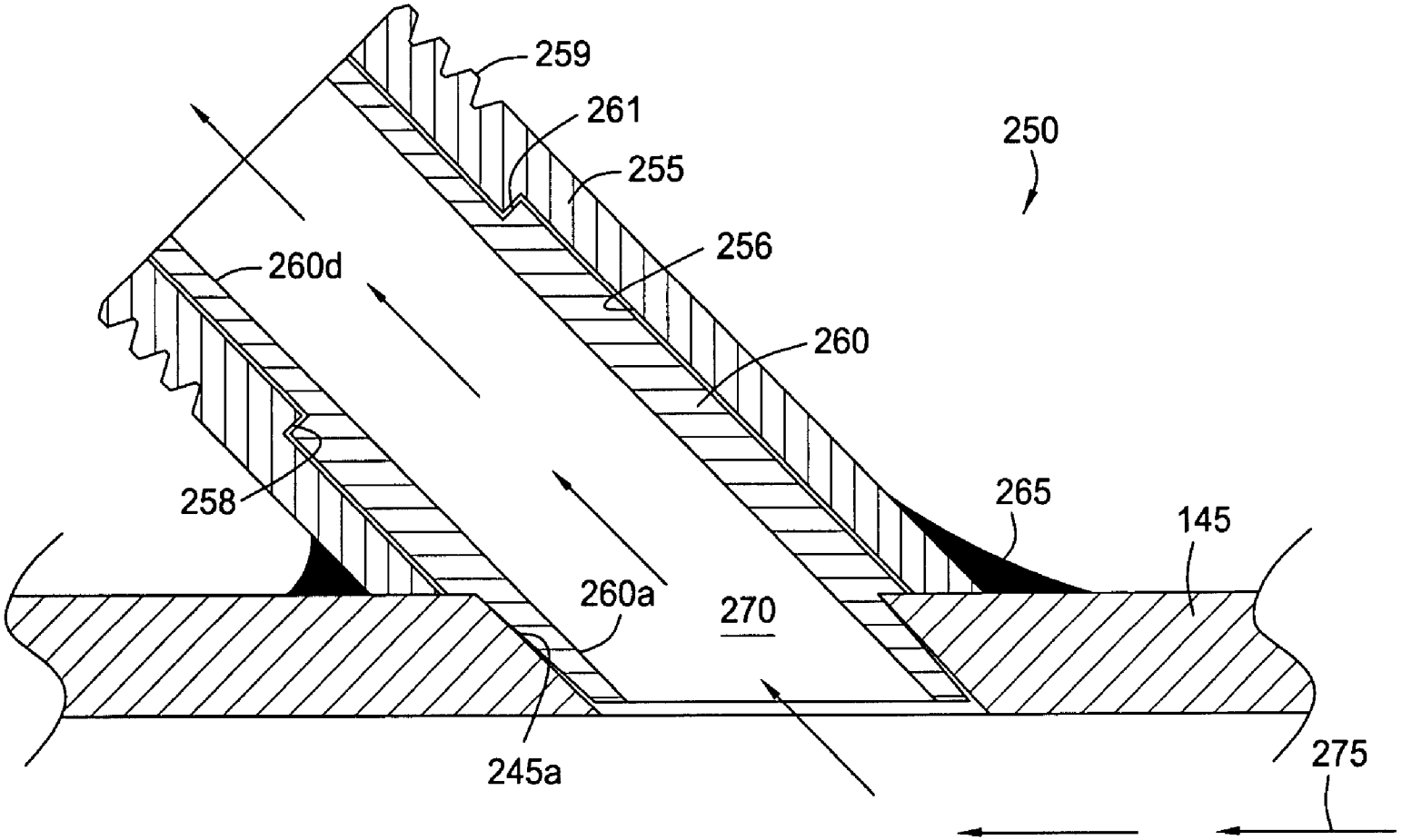
FIG. 5 is a sectional view of a nozzle assembly, according to another embodiment of the present invention, disposed on one of the shunts.

FIG. 5 is a sectional view of a nozzle assembly 250, according to another embodiment of the present invention, disposed on one of the shunts 145. The nozzle assembly 250 comprises an insert 260 with a flow bore therethrough. Preferably, the insert 260 is made from a hard material, e.g., carbide, relative to the material of the shunt 145. A proximal lip 260*a* of the insert 260 extends into an aperture 270 in a wall of the shunt 145, thereby lining a surface 245*a* of the shunt wall that defines the aperture 270. The proximal lip 260*a* can include any of the features described above with respect to the lip 160*a* of the nozzle assembly 150 illustrated in FIG. 4 such that the nozzle assembly 250 is assembled in the same manner with the proximal lip 260*a* serving the same functions.

An outer jacket 255 of the nozzle assembly 250 includes a bore therethrough configured to receive the insert 260. Specifically, a recess 256 along an inner diameter of the outer jacket 255 proximate the aperture 270 accommodates an outer diameter of a medial length of the insert 260. A distal extension 260*d* extends from an opposite end of the insert 260 than the proximal lip 260*a* and has a reduced outer diameter with respect to the medial length of the insert 260 to form an outward shoulder 261. Accordingly, the outer jacket 255 easily slips over the insert 260 and secures to the shunt 145 with a weld 265. Once welded, an inward shoulder 258 defined by the recess 256 of the outer jacket 255 mates with the outward shoulder 261 of the insert 260 to prevent outward movement of the insert 260 with respect to the aperture 270.

The insert 260 and the outer jacket 255 preferably share a common terminus due to a sufficiently sized length of the distal extension 260*d* of the insert 260. In other words, the insert 260 concentrically disposed within the outer jacket 255 lines substantially the entire length of the inner diameter of the outer jacket 255. Threads 259 on an outside end of the outer jacket 255 can replace inner threads to enable securing of a cap (not shown) to the nozzle assembly 250 if desired.

Preferably, the outer jacket 255 and insert 260 are tubular members; however, their shape is not essential to the invention. As with other embodiments described herein, sand slurry 13 exiting the shunt 145, represented by arrows 275, passes through the proximal lip 260*a* of the insert in order to reduce wear on the surface 245*a* of the aperture 270. In addition, sand slurry 13 exiting the nozzle assembly 250 passes through the distal extension 260*d* of the insert 260 without flowing through and contacting an end of the outer jacket 255, which may be made of a softer material similar to the shunt 145. In this manner, the distal extension 260*d* protects the shoulders 258, 261 that cooperate to keep the insert 260 from escaping and causing failure at the nozzle assembly 250. Thus, the insert 260 can provide a carbide conduit that protects all other portions of the nozzle assembly 250 from flow cutting since sand slurry exiting the shunt 145 passes substantially entirely through the carbide conduit. The possibility of flow cutting the surface 245*a* of the aperture 270 or the end of the outer jacket 255 is greatly diminished.

As shown, the nozzle assemblies 150, 250 are used with a shunt of a gravel pack apparatus; however, the nozzle assemblies described herein may be used with various other apparatuses.

While the foregoing is directed to embodiments of the present invention, other and further embodiments of the invention may be devised without departing from the basic scope thereof, and the scope thereof is determined by the claims that follow.

The invention claimed is:

1. A nozzle assembly for use in a tool having a hole through a wall of the tool, comprising:

an insert having varying diameter configured to at least partially line the hole and seat on an exterior surface of the wall proximate the hole, thereby restraining movement of the insert relative to the tool; and wherein the hole is not perpendicular to the surface of the wall proximate the hole.

2. The assembly of claim 1, wherein the insert has a bore therethrough and the insert is configured so that a center of the bore will be substantially aligned with a center of the hole when the insert is seated on the wall of the tool.

3. The assembly of claim 1, wherein the insert is constructed from a material substantially harder than a material of the tool.

4. The assembly of claim 1, wherein the insert is constructed from a carbide material.

5. The assembly of claim 1, wherein the tool is an apparatus for use in a wellbore, comprising:

a wellscreen assembly configured to permit the flow of fluid therethrough while blocking the flow of particulates; and at least one shunt, having an interior bore and an exterior surface, disposed on the wellscreen assembly, wherein the wall is a wall of the shunt, and wherein the insert at least partially lines the hole and seats on the exterior surface of the wall proximate the hole, thereby restraining movement of the insert relative to the shunt.

6. The assembly of claim 1, wherein the insert comprises:

a first portion; and a shoulder portion between the first portion and a lip portion having a diameter smaller than the first portion, wherein the shoulder portion is configured to seat on the surface of the wall proximate the hole.

7. The assembly of claim 6, wherein the lip portion is configured to at least partially line the hole and comprises a tapered portion that is configured to form an interference fit with a surface of the wall defining the hole.

8. The assembly of claim 6, wherein the length of the lip portion substantially corresponds to the thickness of the wall.

9. The assembly of claim 6, wherein the lip portion is configured to at least partially line the hole.

10. The assembly of claim 6, wherein the lip portion comprises a tapered portion that is configured to form an interference fit with a surface of the wall defining the hole.

11. The assembly of claim 6, further comprising a jacket having a bore therethrough and a recessed portion for receiving the first portion of the insert.

12. The assembly of claim 11, further comprising a weld disposed between an outer surface of the jacket and the surface of the wall.

13. The assembly of claim 11, wherein the insert further comprises a second portion extending from the first portion and having a reduced outer diameter with respect to the first portion.

14. The assembly of claim 13, wherein the second portion extends to substantially a terminal end of the jacket distal from the hole.

15. A nozzle assembly for use in a tool having a hole through a wall of the tool, comprising:

an insert having a bore therethrough, wherein the insert is configured to mate with the tool so that a center of the bore is held in substantial alignment with a center of the hole.

a jacket secured to the tool and surrounding the insert, wherein an outer diameter of the insert defines a shoulder for mating with a corresponding shoulder defined within an inner diameter of the jacket, the insert extending beyond the shoulders in the direction of the tool.

16. The nozzle of claim 15, wherein the jacket concentrically surrounds the insert, and wherein substantially an entire length of an inner diameter of the jacket is lined by the insert.

17. The nozzle of claim 15, the insert extending beyond the shoulders in the direction away from the tool.

18. The assembly of claim 15, wherein the tool is an apparatus for use in a wellbore, comprising:

a wellscreen assembly configured to permit the flow of fluid therethrough while blocking the flow of particulates; and at least one shunt, disposed on the wellscreen assembly, wherein the wall is a wall of the shunt, and wherein the insert mates with the tool so that a center of the bore is held in substantial alignment with a center of the hole.

19. The assembly of claim 15, wherein the insert comprises:

a first portion; and a shoulder portion between the first portion and a lip portion, wherein the shoulder portion is configured to seat on a surface of the wall proximate the hole.

20. The assembly of claim 19, wherein the lip portion is configured to at least partially line the hole and comprises a tapered portion that is configured to from an interference fit with a surface of the wall defining the hole.

21. The assembly of claim 19, wherein the jacket has a bore therethrough and a recessed portion for receiving the first portion of the insert.

22. An apparatus for use in a wellbore, comprising:

a wellscreen assembly configured to permit the flow of fluid therethrough while blocking the flow of particulates;

at least one shunt disposed on the wellscreen assembly and having a hole through a wall of the shunt; and a nozzle assembly disposed on the shunt, wherein the nozzle assembly comprises an insert constructed from a material substantially harder than a material of the shunt, the insert comprising:

a first portion; and a shoulder portion between the first portion and a lip portion, wherein the shoulder portion seats on the surface of the wall proximate the hole and the lip portion substantially lines the hole.

23. The nozzle of claim 22, further comprising a jacket concentrically surrounding the insert, wherein substantially an entire length of an inner diameter of the jacket is lined by the insert.

24. A method for attaching a nozzle assembly to a tool, comprising:

inserting an insert into a hole in a wall of the tool until the insert seats on an exterior surface of the wall proximate the hole, thereby lining at least a portion of the hole with the insert and restraining movement of the insert relative to the tool; and wherein the hole is not perpendicular to the surface of the wall proximate the hole.

25. The method of claim 24, further comprising:

disposing a jacket over an outer surface of the insert and seating the jacket on the surface of the wall proximate the hole; and welding the jacket to the surface of the wall.

26. The method of claim 24, wherein the insert comprises a tapered portion and inserting the insert comprises inserting the insert into the hole in the wall of the tool until the tapered portion is press fit with a surface of the wall defining the hole.

27. A dispersal assembly, comprising: at least one shunt having a hole through a wall of the shunt;

a nozzle assembly at least partially disposed in the hole through the wall of the shunt, the nozzle assembly comprising an insert seated on the exterior of the shunt; and a jacket surrounding the insert and attached to the shunt.

28. The assembly of claim 27, wherein the jacket concentrically surrounds the insert.

29. The assembly of claim 27, the insert further comprising:

a first portion; and a shoulder portion between the first portion and a lip portion, wherein the shoulder portion seats on the exterior surface of the shunt proximate the hole and the lip portion substantially lines the hole.

30. The assembly of claim 29, wherein the insert is constructed from a material substantially harder than a material of the shunt.

31. The assembly of claim 27, wherein the hole is not perpendicular to the wall proximate the hole.

32. The assembly of claim 29, wherein the shoulder portion has a larger outer diameter than the first portion.

33. A method for attaching a nozzle assembly to a tool, comprising:

inserting an insert into a hole in a wall of the tool until the insert seats on an exterior surface of the wall proximate the hole, thereby lining at least a portion of the hole with the insert and restraining movement of the insert relative to the tool;

disposing a jacket over an outer surface of the insert and seating the jacket on the surface of the wall proximate the hole; and welding the jacket to the surface of the wall.

34. A method for attaching a nozzle assembly to a tool, comprising:

inserting an insert into a hole in a wall of the tool until the insert seats on an exterior surface of the wall proximate the hole, thereby lining at least a portion of the hole with the insert and restraining movement of the insert relative to the tool, and wherein the insert comprises a tapered portion and inserting the insert comprises inserting the insert into the hole in the wall of the tool until the tapered portion is press fit with a surface of the wall defining the hole.

* * * * *